United States Patent [19]

Hucks

[11] Patent Number: 4,911,685

[45] Date of Patent: Mar. 27, 1990

[54] COIN PACKAGE

[76] Inventor: Billy R. Hucks, 1215 Fairview Dr., Columbia, S.C. 29205-1210

[21] Appl. No.: 262,750

[22] Filed: Oct. 26, 1988

[51] Int. Cl.[4] ..... B31B 49/00

[52] U.S. Cl. ..... 493/264; 493/269; 493/267; 229/87.2; 229/93

[58] Field of Search ..... 229/87.2, 93; 53/414; 493/264, 276, 945, 229, 232, 237, 254, 267, 269

[56] References Cited

U.S. PATENT DOCUMENTS

| | | | |
|---|---|---|---|
| Re. 8,649 | 4/1879 | Rettig | 229/87.2 |
| 221,700 | 11/1879 | Pettee | 493/264 |
| 610,959 | 9/1898 | Cable | 229/87.2 |
| 2,168,504 | 8/1939 | Youmans | 229/87.2 |
| 2,266,547 | 12/1941 | Goodwin | 229/87.2 |
| 3,399,823 | 9/1968 | Johnson | 493/264 |
| 3,533,501 | 10/1970 | Dorsett | 229/87.2 |
| 4,505,425 | 3/1985 | Alsup | 229/87.2 |

*Primary Examiner*—Frederick R. Schmidt
*Assistant Examiner*—Jack W. Lavinder
*Attorney, Agent, or Firm*—Leon Gilden

[57] ABSTRACT

An easy opening coin package is formed with a rectangular web material consisting of a medially notched first edge overfolded by a tabbed second edge which has been laminated with a discontinuous adhesive strip. The fixed first edge fold is spaced from the variable second edge fold dependent upon the diameter of coin size to be wrapped and the non-adhered thumb tab is brought even with the fixed first edge fold for easy opening of the package subsequent to containment of coins therein.

4 Claims, 2 Drawing Sheets

COIN PACKAGE

BACKGROUND OF THE INVENTION

1. Field of the Invention

The present invention relates to coin packages and more particularly pertains to a new and improved package wrapper provided with a discontinuous adhesive strip and a series of indicator lines for wrapping of various denominations of coins by formation of a tube of the planar wrapper with projecting tab secured to the wrapper for ease of opening of the package.

2. Description of the Prior Art

Coin wrappers of various types and constructions have been utilized in the selective wrapping of coins. Typically flexible material such as paper or an equivalent is utilized to securely encase a stack of coins defining a cylinder. Wrappers may be overfolded at their ends to contain the coins or be provided with ridges or abutments to contain coins within the wrapper. For example, U.S. Pat. No. 610,959 to Cable utilizes a wrapper formed with a series of openings and slots for viewing of coins therein with scalloped edges defining the ends of the cylindrical roll to contain the coins within the holder when overfolded upon the coins. The holder has formed a projecting tab on one end interfitting within a slot formed within the other end for securing the coins therein. The Cable patent is limited to a particular dimension of coin, as opposed to the instant invention.

U.S. reissue Pat. No. 8,649 to Rettig sets forth a coin wrapper formed with a series of scalloped edge projections for maintaining coins within a roll wherein a tab, as in the Cable patent, interfits through a slot to maintain the diametrical integrity of the package.

U.S. Pat. No. 2,168,504 to Youmans sets forth a coin holder provided with an elongate continuous adhesive strip and preoriented fold lines for securement of a predesignated diameter of coin, as opposed to the instant invention, wherein the Youmans patent fails to provide any tear tab for subsequent opening of the package.

U.S. Pat. No. 2,266,547 to Goodwin sets forth a coin package wherein a rectangular flexible coin sheet is wrapped about a series of coins diagonally from one apex to an opposing apex with an adhesive formed proximate the other apex for securement to the package with overfolding of the ends of the package to contain the coins therein.

U.S. Pat. No. 4,505,425 to Alsup sets forth a tube-type coin wrapper with an axially oriented tear strip along a formed tube for providing subsequent removal of coins from within the formed tube.

U.S. Pat. No. 3,533,501 to Dorsett sets forth a coin wrapper with foldable crimpable ends formed with a transparent window means to expose edges of the coins to visually illustrate the coins contained therein wherein the window is axially coextensive along an exterior of the formed package.

As such, it may be appreciated that there is a continuing need for a new and improved coin package wherein the same addresses both the problems of ease of use in wrapping coins with subsequent unwrapping of the coins during need, and in this respect, the present invention substantially fulfills this need.

SUMMARY OF THE INVENTION

In view of the foregoing disadvantages inherent in the known types of coin wrappers now present in the prior art, the present invention provides an coin package wherein the same may be efficiently and readily secured and adhered upon itself to form a tubular container and thereafter provided with a tear-tab opening means for subsequent removal of coins stored within the package. As such, the general purpose of the present invention, which will be described subsequently in greater detail, is to provide a new and improved coin package which has all the advantages of the prior art coin packages and none of the disadvantages.

To attain this, the present invention sets forth a generally rectangular flexible wrapper formed with an extending tab projecting from an end thereof to effect opening of a package developed by the instant invention. A discontinuous adhesive with a central discontinuity is laminated to the tab end of the wrapper remote from the first fold line oriented proximate said adhesive with variable fold locations relative to a preselected diameter of coin to be enclosed by the package wherein the wrapper is of a width to extend beyond the column of coins positioned therein for overfolding the ends and containment of coins therein.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved coin package which has all the advantages of the prior art coin packages and none of the disadvantages.

It is another object of the present invention to provide a new and improved coin package which may be easily and efficiently manufactured and marketed.

It is a further object of the present invention to provide a new and improved coin package which is of a durable and reliable construction.

An even further object of the present invention is to provide a new and improved coin package which is susceptible of a low cost of manufacture with regard to both materials and labor, and which accordingly is then susceptible of low prices of sale to the consuming public, thereby making such coin packages economically available to the buying public.

Still yet another object of the present invention is to provide a new and improved coin package which provides in the apparatuses and methods of the prior art some of the advantages thereof, while simultaneously overcoming some of the disadvantages normally associated therewith.

Still another object of the present invention is to provide a new and improved coin wrapper with a prelaminated discontinuous adhesive secured to a second tabbed terminal end of a wrapper for cooperation with a first terminal end to enable subsequent enhanced opening of the package formed by the instant invention.

These together with other objects of the invention. along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
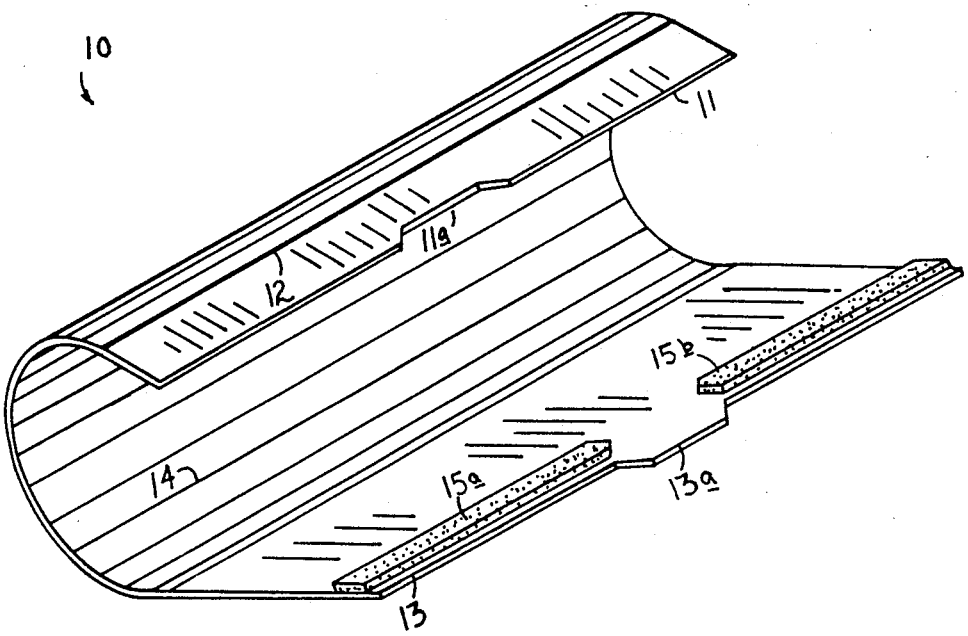
FIG. 1 is an isometric illustration of the instant invention in a first stage of package formation.

With reference now to the drawings, and in particular to FIGS. 1 to 8 thereof, a new and improved coin package embodying the principles and concepts of the present invention and generally designated by the reference numeral 10 will be described.

More specifically, it will be noted that the coin package 10 essentially comprises an elongate flexible wrapper 10*a* of a generally rectangular form with a first elongate edge 11 and a second parallel elongate edge 13. The first elongate edge 11 has formed medially thereon a trapezoidal recess 11*a*.

The parallel and distal second edge 13 has formed medially thereof a trapezoidal projecting thumb tab 13*a* of a dimension equal to that of the trapezoidal recess 11*a*.

Figure 5:
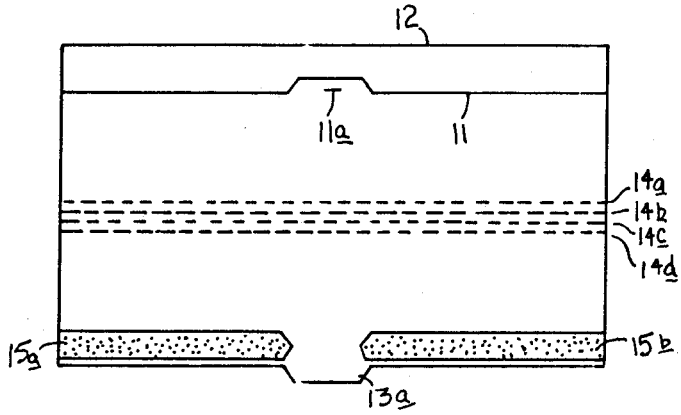
FIG. 5 is a top orthographic view of the instant invention in a second stage.

Attention to FIG. 5 for example, illustrates a discontinuous adhesive strip comprising a first strip 15*a* and a second strip 15*b* oriented to form a non-adhered space terminating to the borders of the trapezoidal recess 11*a* to accommodate trapezoidal tab 13*a*.

Figure 8:
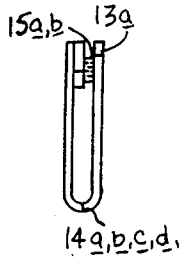
FIG. 8 is a side orthographic view of the instant invention in a third and final stage.

FIG. 8 illustrates a fixed first fold line 12 parallel to the first edge 11 and extending coextensively along the length of the wrapper 10*a*. A variable second fold line 14 is positioned somewhat medially of the wrapper 10*a* and spaced from the first fold line 12 a predetermined distance, to be discussed in more detail below.

Figure 2:
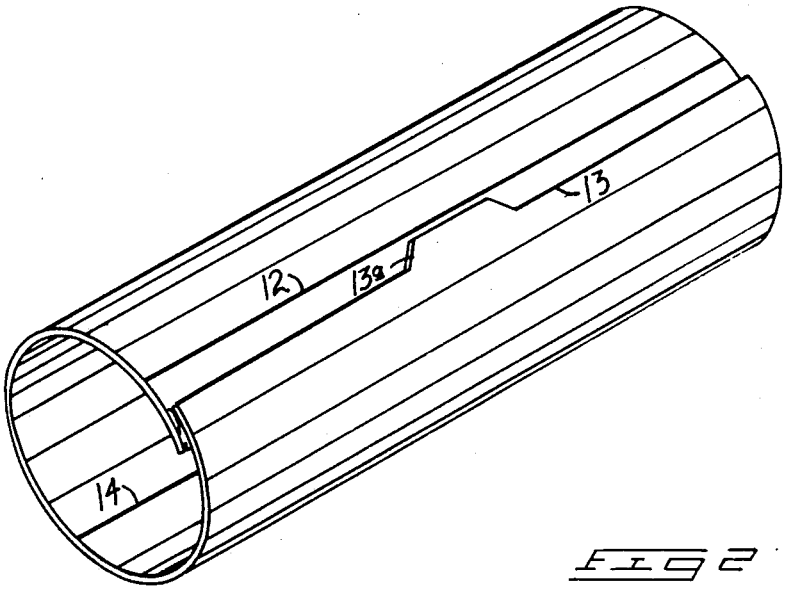
FIG. 2 is an isometric illustration of the instant invention in a second stage of package formation.
Figure 3:
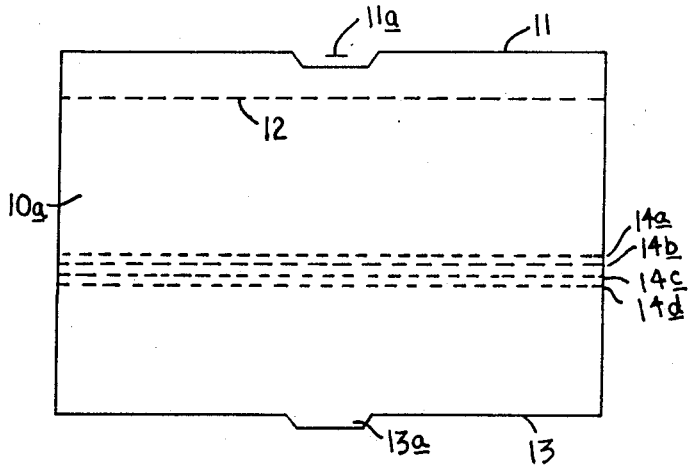
FIG. 3 is a top orthographic view of the instant invention in a first stage.
Figure 4:
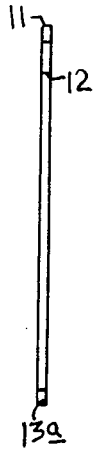
FIG. 4 is a side orthographic view of the instant invention in a first stage.
Figure 6:
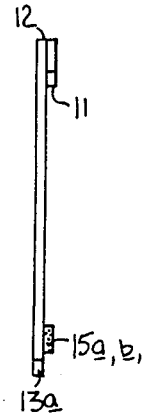
FIG. 6 is a side orthographic view of the instant invention in a second stage.
Figure 7:
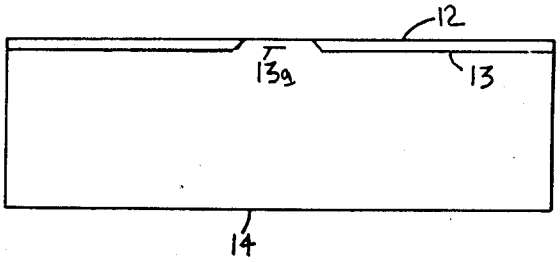
FIG. 7 is a top orthographic view of the instant invention in a third and final stage.

Attention to FIGS. 4, 6 and 8 illustrate the sequence of forming the tubular containers illustrated in FIGS. 1 and 2 wherein initially the wrapper 10*a* is folded about the first fold line 12. The first and second adhesive strips 15*a* and 15*b* are oriented along second edge 13 whereupon a second fold along a selective fold line 14*a*, 14*b*, 14*c*, or 14*d* enables overfolding of the wrappers illustrated in FIG. 8 to develop an enclosure that may be opened for acceptance of coins, as illustrated in FIG. 2, where upon insertion of a selected diameter of coins, the ends of the so-formed hollow cylinder are overfolded upon themselves to contain the coins therein in a manner, as represented in U.S. Pat. No. 8,588,501 to Dorsett, for example. 14*a*, 14*b*, 14*c*, and 14*d* depends upon the diameter and type of coin selected. The distance from first fold line 12 to second fold line 14, should a dime be selected, is 1 and 5/32nds inches depicted by fold line 14*a*, a selection of a penny will provide a distance of 1 and ¼ inches from first fold line 12 to second fold line 14*b*, the selection of a nickel will require a distance of 1 and 3/8ths from first fold line 12 to second fold line 14*c*, and finally the selection of a quarter will require a distance of 1 and 9/16th inches from first fold line 12 to second fold line 14*d*.

The distance from the first fold line 12 to the second fold line 14 is determined by the diameter of a coin wherein the distance is within a range of 1.5 to 1.7 times the diameter of the associated coin and about from dimension of 1.67 times the dimension of the coin to be wrapped. In this manner, the above recited relationships of the dimension for a penny, nickel, dime and quarter are determined.

As to the manner of usage and operation of the instant invention, the same should be apparent from the above disclosure, accordingly no further discussion relative to the manner of usage and operation will be described.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A method of forming a coin package for containment of a cylindrical stack of coins comprising the steps of, A. providing a rectangular sheet of a flexible non-resilient web of a length less than that of said stack of coins, and B. forming a trapezoidal recess orthogonally to a first lengthwise edge, and C. forming a trapezoidal tab orthogonally to a second lengthwise edge, and D. laminating a discontinuous adhesive strip adjacent a second lengthwise edge parallel to said first edge of said web, and E. overloading of said trapezoidal recess along a fold line spaced from said first edge a distance greater than a width defined by said adhesive strip, and F. adhering said discontinuous adhesive strip adjacent said second edge by folding said web along a second fold line parallel to said first fold line wherein the adhesive strip is positioned between said first fold line and said first edge with the trapezoidal tab aligning with the first fold line, and comprising a further step of spacing said second fold line relative to said first fold line a distance approximately equal to 1.5 to 1.7 times the diameter of a coin of said stack of coins.

2. A method of forming a coin package as set forth in claim 1 wherein the second fold line is spaced from said first fold line a distance approximately equal to 1.67 times the diameter of a coin of said coin stack.

3. A method of forming a coin package as set forth in claim 2 wherein the step of providing a web includes forming a recess within said first edge medially of said first edge of a configuration reciprocally equal to that of said second edge projecting trapezoidal tab.

4. A method of forming a coin package as set forth in claim 3 wherein the step of providing a web includes forming a thumb tab on said second edge medially of said second edge of a configuration reciprocally equal to that of said first edge medial trapezoidal recess.

* * * * *